US009651905B2

(12) United States Patent
Fujimoto et al.

(10) Patent No.: US 9,651,905 B2
(45) Date of Patent: May 16, 2017

(54) FIXING DEVICE AND IMAGE FORMING APPARATUS

(71) Applicants: Ippei Fujimoto, Kanagawa (JP); Kazuhito Kishi, Kanagawa (JP); Takashi Seto, Kanagawa (JP); Takayuki Seki, Kanagawa (JP); Kazunari Sawada, Kanagawa (JP); Kenji Ishii, Kanagawa (JP); Hiroshi Yoshinaga, Chiba (JP); Hiromasa Takagi, Tokyo (JP); Takamasa Hase, Tokyo (JP); Yasuhiko Ogino, Kanagawa (JP); Shohta Kobashigawa, Tokyo (JP)

(72) Inventors: Ippei Fujimoto, Kanagawa (JP); Kazuhito Kishi, Kanagawa (JP); Takashi Seto, Kanagawa (JP); Takayuki Seki, Kanagawa (JP); Kazunari Sawada, Kanagawa (JP); Kenji Ishii, Kanagawa (JP); Hiroshi Yoshinaga, Chiba (JP); Hiromasa Takagi, Tokyo (JP); Takamasa Hase, Tokyo (JP); Yasuhiko Ogino, Kanagawa (JP); Shohta Kobashigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/190,341

(22) Filed: Jun. 23, 2016

(65) Prior Publication Data

US 2017/0010570 A1 Jan. 12, 2017

(30) Foreign Application Priority Data

Jul. 7, 2015 (JP) ..... 2015-135917

(51) Int. Cl.
*G03G 15/20* (2006.01)

(52) U.S. Cl.
CPC ..... *G03G 15/2053* (2013.01)

(58) Field of Classification Search
USPC ..... 399/107, 110, 122, 320, 328, 329; 219/216, 619
See application file for complete search history.

(56) References Cited

U.S. PATENT DOCUMENTS 7,742,733 B2 * 6/2010 Barton ..... G03G 15/2039 219/216
7,809,316 B2 * 10/2010 Van Sas ..... G03G 15/2032 219/216

(Continued)

FOREIGN PATENT DOCUMENTS

JP 2007-310220 11/2007
JP 2008-139382 6/2008

(Continued)

OTHER PUBLICATIONS

U.S. Appl. No. 14/979,686, filed Dec. 28, 2015.

(Continued)

*Primary Examiner* — Hoan Tran
(74) *Attorney, Agent, or Firm* — Oblon, McClelland, Maier & Neustadt, L.L.P.

(57) ABSTRACT

A fixing device includes a fixing rotator and a heater disposed inside the fixing rotator to heat the fixing rotator with radiant heat. A pressure rotator presses against the fixing rotator to form a fixing nip between the fixing rotator and the pressure rotator. A reflector is disposed opposite the heater to reflect the radiant heat radiated from the heater to the fixing rotator. The reflector includes a first parallel plane, a second parallel plane, and a third tilt plane. The second parallel plane is parallel to the first parallel plane and stepped with respect to the first parallel plane. The second (Continued)

parallel plane is disposed closer to the fixing nip and the heater than the first parallel plane. The third tilt plane bridges the first parallel plane and the second parallel plane and is disposed opposite the heater.

13 Claims, 6 Drawing Sheets

(56) References Cited

U.S. PATENT DOCUMENTS

2010/0067929 A1 3/2010 Seki
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2011/0026988 A1 2/2011 Yoshikawa et al.
2011/0044734 A1 2/2011 Shimokawa et al.
2011/0052237 A1 3/2011 Yoshikawa et al.
2011/0052245 A1 3/2011 Shinshi et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0076071 A1 3/2011 Yamaguchi et al.
2011/0085832 A1 4/2011 Hasegawa et al.
2011/0116848 A1 5/2011 Yamaguchi et al.
2011/0129268 A1 6/2011 Ishii et al.
2011/0170917 A1 7/2011 Yoshikawa et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0274453 A1 11/2011 Shimokawa et al.
2012/0051774 A1 3/2012 Ikebuchi et al.
2012/0114345 A1 5/2012 Fujimoto et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0224878 A1 9/2012 Ikebuchi et al.
2012/0237273 A1 9/2012 Yoshinaga et al.
2012/0288308 A1 11/2012 Kobashigawa
2012/0301161 A1 11/2012 Fujimoto
2013/0045032 A1 2/2013 Shimokawa et al.
2013/0164056 A1 6/2013 Imada et al.
2013/0164058 A1 6/2013 Suzuki et al.
2013/0164059 A1 6/2013 Takagi et al.
2013/0170877 A1 7/2013 Yoshiura et al.
2013/0170879 A1 7/2013 Yoshinaga et al.
2013/0170880 A1 7/2013 Gotoh et al.
2013/0177340 A1 7/2013 Kawata et al.
2013/0183070 A1 7/2013 Kawata et al.
2013/0183071 A1 7/2013 Iwaya et al.
2013/0183072 A1 7/2013 Hase et al.
2013/0188977 A1 7/2013 Hase et al.
2013/0188991 A1 7/2013 Kawata et al.
2013/0189005 A1 7/2013 Saito et al.
2013/0189008 A1 7/2013 Ishii et al.
2013/0195477 A1 8/2013 Seshita et al.
2013/0195493 A1 8/2013 Hase et al.
2013/0195523 A1 8/2013 Yamaji et al.
2013/0195524 A1 8/2013 Ishii et al.
2013/0195525 A1 8/2013 Yoshinaga et al.
2013/0202320 A1 8/2013 Hase et al.
2013/0209115 A1 8/2013 Hase et al.
2013/0209119 A1 8/2013 Yuasa et al.
2013/0209120 A1 8/2013 Namekata et al.
2013/0209121 A1 8/2013 Uchitani et al.
2013/0209122 A1 8/2013 Yamashina et al.
2013/0209123 A1 8/2013 Waida et al.
2013/0209124 A1 8/2013 Saito et al.
2013/0209125 A1 8/2013 Uchitani et al.
2013/0209126 A1 8/2013 Seo et al.
2013/0209127 A1 8/2013 Fujimoto et al.
2013/0209128 A1 8/2013 Saito et al.
2013/0209131 A1 8/2013 Uchitani et al.
2013/0209139 A1 8/2013 Ogawa et al.
2013/0209146 A1 8/2013 Yamaji et al.
2013/0209147 A1 8/2013 Ogawa et al.
2013/0236225 A1 9/2013 Ogawa et al.
2013/0251390 A1 9/2013 Ishii et al.
2013/0251422 A1 9/2013 Iwaya et al.
2013/0251430 A1 9/2013 Fujimoto et al.
2013/0266355 A1 10/2013 Yoshiura et al.
2014/0010578 A1 1/2014 Ishigaya et al.
2014/0016971 A1 1/2014 Arai et al.
2014/0016972 A1 1/2014 Seshita et al.
2014/0064804 A1 3/2014 Yamaguchi et al.
2014/0072355 A1 3/2014 Tamaki et al.
2014/0079424 A1 3/2014 Ikebuchi et al.
2014/0079453 A1 3/2014 Arai et al.
2014/0079455 A1 3/2014 Seki et al.
2014/0112691 A1 4/2014 Nanno et al.
2014/0133879 A1 5/2014 Seshita et al.
2014/0241766 A1 8/2014 Ishii et al.
2014/0248072 A1 9/2014 Yoshinaga et al.
2014/0270820 A1 9/2014 Saito et al.
2014/0270822 A1 9/2014 Yamashina et al.
2014/0270831 A1 9/2014 Yoshinaga et al.
2014/0270832 A1 9/2014 Saito et al.
2014/0270833 A1 9/2014 Yuasa et al.
2014/0270872 A1 9/2014 Tamaki et al.
2014/0270875 A1 9/2014 Mimbu et al.
2014/0286684 A1 9/2014 Takagi et al.
2014/0341623 A1 11/2014 Arai et al.
2014/0341624 A1 11/2014 Arai et al.
2014/0341625 A1 11/2014 Imada et al.
2014/0341626 A1 11/2014 Mimbu et al.
2014/0341627 A1 11/2014 Yoshikawa et al.
2014/0356036 A1 12/2014 Shimokawa et al.
2014/0356037 A1 12/2014 Shimokawa et al.
2014/0356038 A1 12/2014 Arai et al.
2014/0369703 A1 12/2014 Hase et al.
2015/0023705 A1 1/2015 Kawata et al.
2015/0055994 A1 2/2015 Shoji et al.
2015/0063884 A1 3/2015 Iwaya et al.
2015/0071661 A1 3/2015 Yamashina et al.
2015/0098738 A1 4/2015 Arai et al.
2015/0104230 A1 4/2015 Uchitani et al.
2015/0110531 A1 4/2015 Takagi et al.
2015/0125193 A1 5/2015 Ishii et al.
2015/0160591 A1 6/2015 Hase et al.
2015/0168897 A1 6/2015 Ogawa et al.
2015/0185671 A1 7/2015 Ikebuchi et al.

(56) References Cited

U.S. PATENT DOCUMENTS

| | | | |
|---|---|---|---|
| 2015/0212459 | A1 | 7/2015 | Hase et al. |
| 2015/0227095 | A1 | 8/2015 | Uchitani et al. |
| 2015/0234329 | A1 | 8/2015 | Hase et al. |
| 2015/0261155 | A1 | 9/2015 | Yoshiura et al. |
| 2015/0261157 | A1 | 9/2015 | Yamano et al. |
| 2015/0268597 | A1 | 9/2015 | Arai et al. |
| 2015/0355586 | A1 | 12/2015 | Fujimoto et al. |
| 2015/0355587 | A1 | 12/2015 | Tada et al. |
| 2015/0378290 | A1 | 12/2015 | Kawata et al. |
| 2016/0004197 | A1 | 1/2016 | Imada et al. |
| 2016/0054691 | A1 | 2/2016 | Hase et al. |
| 2016/0098003 | A1 | 4/2016 | Uchitani et al. |
| 2016/0147185 | A1 | 5/2016 | Hase et al. |

FOREIGN PATENT DOCUMENTS

| | | |
|---|---|---|
| JP | 2008-197637 | 8/2008 |
| JP | 2010-078839 | 4/2010 |
| JP | 2011-237831 | 11/2011 |
| JP | 2013-164474 | 8/2013 |
| JP | 2014-085499 | 5/2014 |

OTHER PUBLICATIONS

U.S. Appl. No. 14/992,643, filed Jan. 11, 2016.
U.S. Appl. No. 15/010,012, filed Jan. 29, 2016.
U.S. Appl. No. 15/011,886, filed Feb. 1, 2016.
U.S. Appl. No. 15/011,982, filed Feb. 1, 2016.
U.S. Appl. No. 15/013,827, filed Feb. 2, 2016.
U.S. Appl. No. 15/063,755, filed Mar. 8, 2016.
U.S. Appl. No. 15/052,450, filed Feb. 24, 2016.
U.S. Appl. No. 15/063,769, filed Mar. 8, 2016.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2015-135917, filed on Jul. 7, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator that presses against the fixing rotator in a pressurization direction to form a fixing nip between the fixing rotator and the pressure rotator, through which a recording medium bearing a toner image is conveyed. A heater is disposed inside the fixing rotator to heat the fixing rotator with radiant heat. A reflector is disposed opposite the heater to reflect the radiant heat radiated from the heater to the fixing rotator. The reflector includes a first parallel plane, a second parallel plane, and a third tilt plane. The second parallel plane is parallel to the first parallel plane and stepped with respect to the first parallel plane. The second parallel plane is disposed closer to the fixing nip and the heater than the first parallel plane. The third tilt plane bridges the first parallel plane and the second parallel plane and is disposed opposite the heater.

This specification further describes an improved image forming apparatus. In one exemplary embodiment, the image forming apparatus includes an image forming device to form a toner image on a recording medium and a fixing device disposed downstream from the image forming device in a recording medium conveyance direction to fix the toner image on the recording medium. The fixing device includes a fixing rotator rotatable in a predetermined direction of rotation and a pressure rotator that presses against the fixing rotator in a pressurization direction to form a fixing nip between the fixing rotator and the pressure rotator, through which the recording medium bearing the toner image is conveyed. A heater is disposed inside the fixing rotator to heat the fixing rotator with radiant heat. A reflector is disposed opposite the heater to reflect the radiant heat radiated from the heater to the fixing rotator. The reflector includes a first parallel plane, a second parallel plane, and a third tilt plane. The second parallel plane is parallel to the first parallel plane and stepped with respect to the first parallel plane. The second parallel plane is disposed closer to the fixing nip and the heater than the first parallel plane. The third tilt plane bridges the first parallel plane and the second parallel plane and is disposed opposite the heater.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
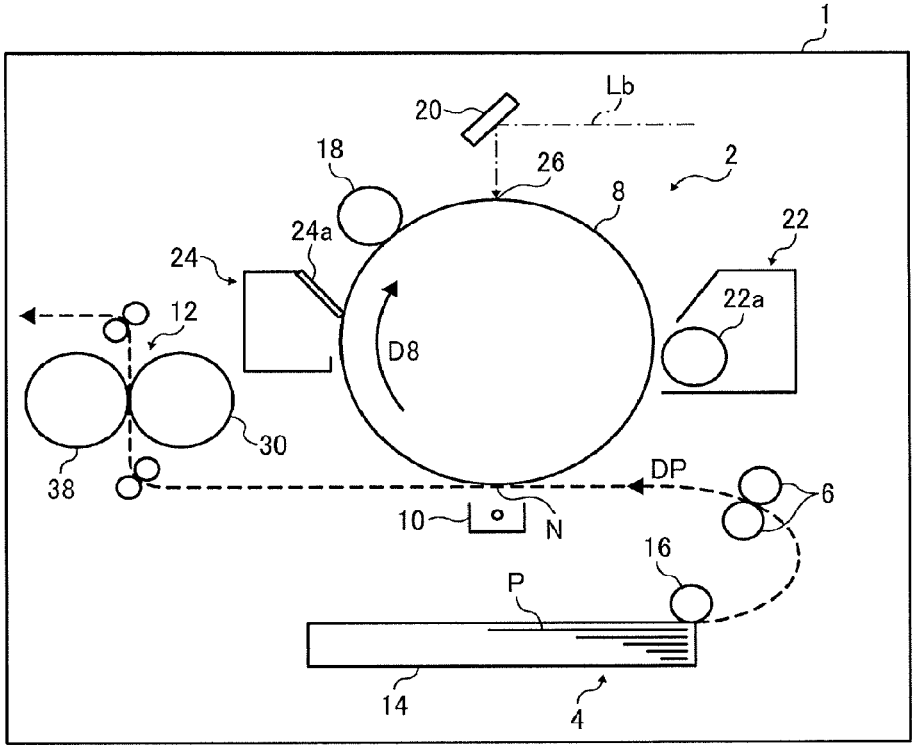
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a monochrome printer that forms a monochrome toner image on a recording medium by electrophotography. Alternatively, the image forming apparatus 1 may be a color printer that forms a color toner image on a recording medium.

Referring to FIG. 1, a description is provided of a construction of the image forming apparatus 1.

As illustrated in FIG. 1, the image forming apparatus 1 includes a sheet feeder 4, a registration roller pair 6, a photoconductive drum 8 serving as an image bearer, a transfer device 10, and a fixing device 12.

The sheet feeder 4 includes a paper tray 14 that loads a plurality of sheets P serving as recording media and a feed roller 16 that picks up and feeds an uppermost sheet P of the plurality of sheets P loaded on the paper tray 14. The registration roller pair 6 temporarily halts the sheet P conveyed by the feed roller 16 to correct skew of the sheet P. Thereafter, the registration roller pair 6 conveys the sheet P to a transfer nip N formed between the photoconductive drum 8 and the transfer device 10 at a time in synchronism with rotation of the photoconductive drum 8, that is, at a time when a leading edge of a toner image formed on the photoconductive drum 8 corresponds to a predetermined position in a leading end of the sheet P in a sheet conveyance direction DP.

The photoconductive drum 8 is surrounded by a charging roller 18, a mirror 20 constituting a part of an exposure device, a developing device 22 incorporating a developing roller 22*a*, the transfer device 10, and a cleaner 24 incorporating a cleaning blade 24*a*, which are arranged in this order in a rotation direction D8 of the photoconductive drum 8. A light beam Lb reflected by the mirror 20 irradiates and scans the photoconductive drum 8 at an exposure position 26 thereon interposed between the charging roller 18 and the developing device 22 in the rotation direction D8 of the photoconductive drum 8.

A description is provided of an image forming operation to form a toner image on a sheet P that is performed by the image forming apparatus 1 having the construction described above.

As the photoconductive drum 8 starts rotating, the charging roller 18 uniformly charges an outer circumferential surface of the photoconductive drum 8. The exposure device emits a light beam Lb onto the charged outer circumferential surface of the photoconductive drum 8 at the exposure position 26 thereon according to image data sent from an external device such as a client computer, thus forming an electrostatic latent image on the photoconductive drum 8. The electrostatic latent image formed on the photoconductive drum 8 moves in accordance with rotation of the photoconductive drum 8 to a developing position thereon disposed opposite the developing device 22 where the developing device 22 supplies toner to the electrostatic latent image on the photoconductive drum 8, visualizing the electrostatic latent image as a toner image. As the toner image formed on the photoconductive drum 8 reaches the transfer nip N, the toner image is transferred onto a sheet P conveyed from the paper tray 14 and entering the transfer nip N at a predetermined time by a transfer bias applied by the transfer device 10. The sheet P bearing the toner image is conveyed to the fixing device 12 where a fixing belt 38 and a pressure roller 30 fix the toner image on the sheet P under heat and pressure. Thereafter, the sheet P bearing the fixed toner image is ejected onto an output tray that stacks the sheet P.

On the other hand, residual toner failed to be transferred from the photoconductive drum 8 onto the sheet P at the transfer nip N and therefore remaining on the photoconductive drum 8 moves in accordance with rotation of the photoconductive drum 8 to a cleaning position on the photoconductive drum 8 that is disposed opposite the cleaner 24. At the cleaning position, the cleaning blade 24*a* of the cleaner 24 scrapes the residual toner off the photoconductive drum 8, thus cleaning the outer circumferential surface of the photoconductive drum 8. Thereafter, a discharger removes residual potential on the photoconductive drum 8, rendering the photoconductive drum 8 to be ready for a next image forming operation. The photoconductive drum 8, the charging roller 18, the developing device 22, the transfer device 10, and the cleaner 24 constitute an image forming device 2 that forms the toner image on the sheet P.

A description is provided of a construction of the fixing device 12 incorporated in the image forming apparatus 1 having the construction described above.

Figure 2:
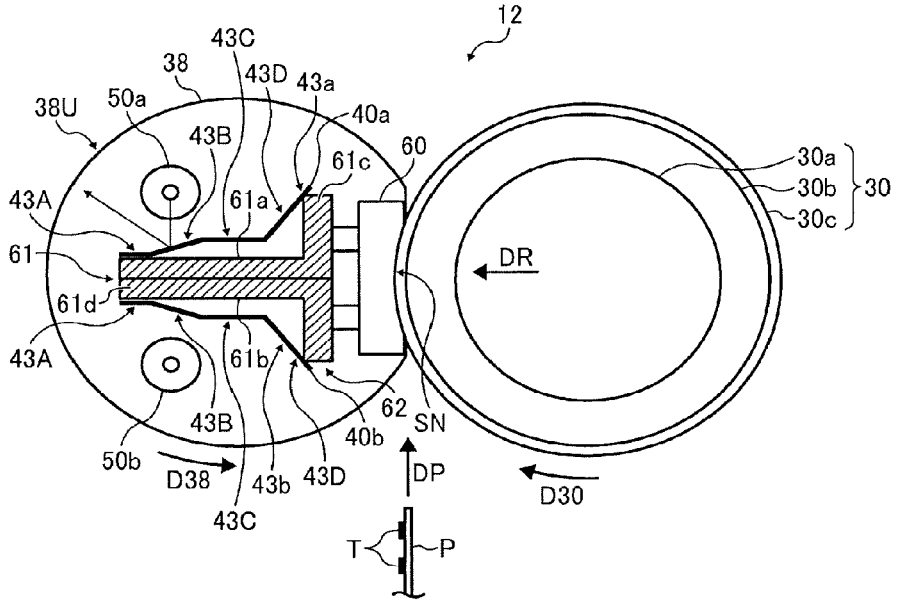
FIG. 2 is a schematic vertical cross-sectional view of a fixing device incorporated in the image forming apparatus illustrated in FIG. 1.

FIG. 2 is a vertical cross-sectional view of the fixing device 12. As illustrated in FIG. 2, the fixing device 12 (e.g., a fuser or a fusing unit) includes the fixing belt 38 serving as a fixing rotator or an endless belt formed into a loop and rotatable in a rotation direction D38, the pressure roller 30 serving as an abutment rotator or a pressure rotator rotatable in a rotation direction D30, a pressure pad 60 serving as a nip formation pad, two halogen heaters 50*a* and 50*b* serving as a heater, a stay 61 serving as a reinforcement, and two reflection plates 40*a* and 40*b* serving as a reflector. The pressure pad 60 and the stay 61 constitute a nip formation assembly 62. The fixing belt 38 and the components disposed inside the loop formed by the fixing belt 38, that is, the reflection plates 40*a* and 40*b*, the halogen heaters 50*a* and 50*b*, the pressure pad 60, and the stay 61, may constitute a belt unit 38U separably coupled with the pressure roller 30.

A detailed description is now given of a construction of the fixing belt 38.

The fixing belt 38 is constructed of a base layer, an elastic layer coating the base layer, and a release layer coating the elastic layer. The base layer, made of nickel (Ni), has an outer diameter of 30 mm and a thickness in a range of from 10 micrometers to 70 micrometers, for example. The elastic layer made of silicone rubber has a thickness in a range of from 50 micrometers to 150 micrometers. The release layer serving as an outermost layer has a thickness in a range of from 5 micrometers to 50 micrometers and is made of fluoroplastic such as tetrafluoroethylene-perfluoroalkylvinylether copolymer (PFA) and polytetrafluoroethylene (PTFE), for example, to enhance durability of the fixing belt 38 and facilitate separation of toner of a toner image T on a sheet P from the fixing belt 38. Alternatively, the base layer of the fixing belt 38 may be made of a material other than nickel, for example, metal such as SUS stainless steel or heat resistant resin such as polyimide (PI).

A detailed description is now given of a construction of the pressure roller 30.

The pressure roller 30, having an outer diameter of 30 mm, is constructed of a hollow cored bar 30*a* made of iron, an elastic layer 30*b* coating the cored bar 30*a*, and a release layer 30*c* coating the elastic layer 30*b*. The elastic layer 30*b*, made of silicone rubber, has a thickness of 5 mm. The fluoroplastic release layer 30*c* having a thickness of about 40 micrometers may coat the elastic layer 30*b* to facilitate separation of a foreign substance (e.g., paper dust and toner) from the pressure roller 30. A biasing member (e.g., a spring) biases and presses the pressure roller 30 against the fixing belt 38.

A detailed description is now given of a configuration of the pressure pad 60.

The pressure pad 60 made of heat resistant resin such as liquid crystal polymer (LCP) presses against the pressure roller 30 via the fixing belt 38 to form a fixing nip SN between the fixing belt 38 and the pressure roller 30. As the fixing belt 38 rotates in the rotation direction D38, an inner circumferential surface of the fixing belt 38 slides over the pressure pad 60.

A detailed description is now given of a configuration of the stay 61.

The pressure pad 60 is mounted on and supported by the stay 61. Both lateral ends of the stay 61 in a longitudinal direction thereof are supported by a plurality of side plates disposed at both lateral ends of the fixing device 12 in a longitudinal direction thereof parallel to an axial direction of the fixing belt 38, respectively. The stay 61 supports or reinforces the pressure pad 60 against pressure from the pressure roller 30.

A detailed description is now given of a construction of the halogen heaters 50*a* and 50*b*.

The two halogen heaters 50*a* and 50*b* are disposed opposite each other via the stay 61. A bracket supports each lateral end of the respective halogen heaters 50*a* and 50*b* in a longitudinal direction thereof parallel to the axial direction of the fixing belt 38. The halogen heater 50*a* includes a glass tube and a luminous filament disposed inside the glass tube. The luminous filament spans a decreased span in the longitudinal direction of the halogen heater 50*a*. The decreased span corresponds to a width of a small sheet P in a width direction thereof parallel to the longitudinal direction of the halogen heater 50*a*. The halogen heater 50*b* includes a glass tube and a luminous filament disposed inside the glass tube. The luminous filament spans an increased span in the longitudinal direction of the halogen heater 50*b*. The increased span corresponds to a width of a large sheet P in a width direction thereof parallel to the longitudinal direction of the halogen heater 50*b*. The increased span of the halogen heater 50*b* is disposed outboard from the decreased span of the halogen heater 50*a* in the longitudinal direction thereof. It is to be noted that each of the halogen heaters 50*a* and 50*b* is hereinafter referred to as a halogen heater 50 if the halogen heater 50*a* is not distinguished from the halogen heater 50*b*.

A detailed description is now given of a construction of the reflection plates 40*a* and 40*b*.

The reflection plate 40*a* is in contact with or in proximity to an opposed face 61*a* of the stay 61 that is disposed opposite the halogen heater 50*a*. Similarly, the reflection plate 40*b* is in contact with or in proximity to an opposed face 61*b* of the stay 61 that is disposed opposite the halogen heater 50*b*. Each of the reflection plates 40*a* and 40*b* is constructed of an aluminum base and a silver paste layer coating the base. The reflection plates 40*a* and 40*b* reflect radiant heat or light radiated from the halogen heaters 50*a* and 50*b* toward the fixing belt 38, respectively, by specular reflection. Each of the reflection plates 40*a* and 40*b* is a polygonal plate in cross-section that shields the stay 61 and the pressure pad 60 from the halogen heaters 50*a* and 50*b*.

Referring to FIG. 2, a description is provided of a shape of each of the reflection plates 40*a* and 40*b*.

As illustrated in FIG. 2, the stay 61 includes a base 61*c* and a projection 61*d* (e.g., an arm) projecting from the base 61*c* in a direction perpendicular to the longitudinal direction of the stay 61. That is, the projection 61*d* projects with respect to the pressure pad 60 to support the pressure pad 60 against pressure from the pressure roller 30 exerted in a pressurization direction DR. Each of the reflection plates 40*a* and 40*b* is disposed opposite the projection 61*d* to cover the projection 61*d*. Each of the reflection plates 40*a* and 40*b* includes two reflection planes 43A and 43C that are parallel to each other and constitute steps and a reflection plane 43B that is tilted relative to the reflection planes 43A and 43C and bridges the reflection planes 43A and 43C.

Each of the halogen heaters 50*a* and 50*b* is disposed opposite the reflection plane 43B. An incidence angle of the radiant heat or light that irradiates a slope of the reflection plane 43B is not perpendicular to the slope of the reflection plane 43B. Accordingly, the reflection plane 43B reflects the radiant heat or light in a reflection direction different from an incidence direction of the radiant heat or light, thus preventing the radiant heat or light reflected by the reflection plane 43B from irradiating the respective halogen heaters 50*a* and 50*b*. Accordingly, the radiant heat or light radiated from the respective halogen heaters 50*a* and 50*b* and reflected by the reflection plane 43B is not directed back to the respective halogen heaters 50*a* and 50*b* and is directed to a circumferential span of the fixing belt 38 that is disposed opposite the pressure pad 60 via the respective halogen heaters 50*a* and 50*b*. Consequently, the reflection plane 43B prevents the reflected heat or light from being directed to and heating the glass tube of the respective halogen heaters 50*a* and 50*b*, improving heating efficiency in heating the fixing belt 38.

The projection 61*d* of the stay 61 projects in the pressurization direction DR of the pressure roller 30 in which the pressure roller 30 is pressed against the pressure pad 60 via the fixing belt 38. The pressurization direction DR is perpendicular to the sheet conveyance direction DP. The projection 61*d* projects with respect to the fixing nip SN in the pressurization direction DR. The reflection planes 43A and 43C are parallel to the projection 61*d* projecting in the pressurization direction DR. Accordingly, the stay 61 and the reflection plates 40*a* and 40*b* occupy a decreased space inside the loop formed by the fixing belt 38, downsizing the fixing device 12.

A description is provided of a construction of a first comparative fixing device 12C1.

Figure 3:
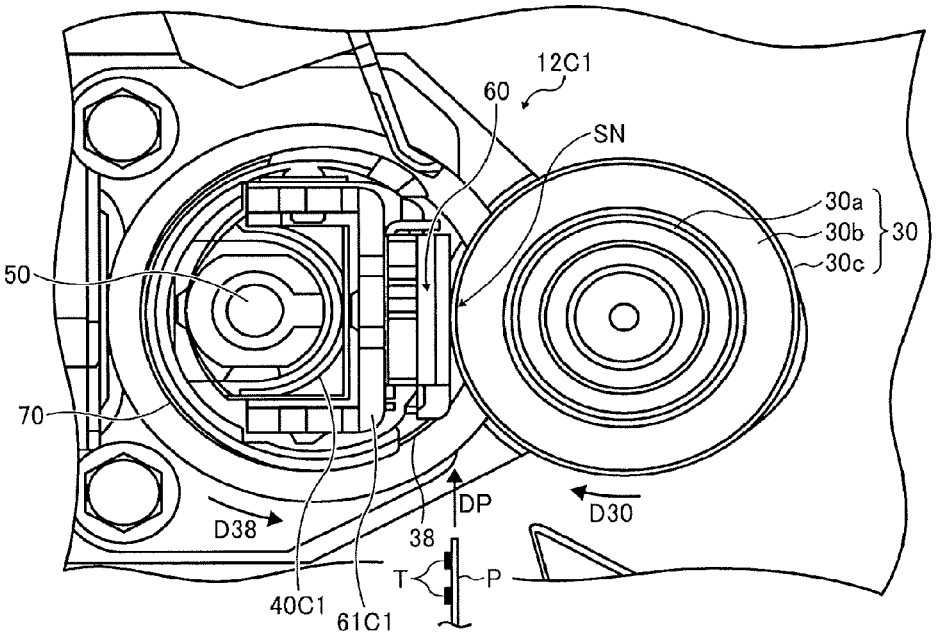
FIG. 3 is a schematic vertical cross-sectional view of a first comparative fixing device.

FIG. 3 is a schematic vertical cross-sectional view of the first comparative fixing device 12C1. As illustrated in FIG. 3, the first comparative fixing device 12C1 includes the fixing belt 38 and the pressure roller 30 serving as a pressure rotator. The halogen heater 50 serving as a heater or a heat source emits heat or light that irradiates the inner circumferential surface of the fixing belt 38 directly, heating the fixing belt 38 with radiant heat or light. The pressure pad 60 is disposed inside the loop formed by the fixing belt 38 and presses against the pressure roller 30 via the fixing belt 38 to form the fixing nip SN between the fixing belt 38 and the pressure roller 30. As the fixing belt 38 rotates in the rotation direction D38, the inner circumferential surface of the fixing belt 38 slides over the pressure pad 60 directly or indirectly via a slide sheet (e.g., a low-friction sheet). As illustrated in FIG. 3, the fixing nip SN is planar. Alternatively, the fixing nip SN may define a recess, a curve, or other shapes. If the fixing nip SN defines a recess or a curve, the curved fixing nip SN directs a leading edge of a sheet P toward the pressure roller 30 as the sheet P is ejected from the fixing nip SN, facilitating separation of the sheet P from the fixing belt 38 and suppressing jamming of the sheet P.

The fixing belt 38 is an endless belt or film made of metal such as nickel and SUS stainless steel or resin such as polyimide. The fixing belt 38 includes the release layer constituting the outer circumferential surface of the fixing belt 38 and being made of PFA, PTFE, or the like to facilitate separation of toner of a toner image T on the sheet P and therefore prevent adhesion of the toner to the fixing belt 38. Optionally, an elastic layer made of rubber such as silicone rubber, silicone rubber foam, and fluoro rubber may be interposed between the base layer and the release layer. If the fixing belt 38 does not incorporate the elastic layer, the fixing belt 38 has a decreased thermal capacity that improves fixing property of being heated quickly to a desired fixing temperature at which the toner image T is fixed on the sheet P. However, as the pressure roller 30 and the fixing belt 38 sandwich and press the unfixed toner image T on the sheet P passing through the fixing nip SN, slight surface asperities of the fixing belt 38 may be transferred onto the toner image T on the sheet P, resulting in variation in gloss of the solid toner image T that may appear as an orange peel image on the sheet P. To address this circumstance, it is preferable that the fixing belt 38 incorporates the elastic layer having a thickness not smaller than 100 micrometers. The elastic layer having the thickness not smaller than 100 micrometers elastically deforms to absorb slight surface asperities of the fixing belt 38, preventing variation in gloss of the toner image T on the sheet P that may appear as an orange peel image.

A stay 61C1 serving as a support that supports the pressure pad 60 is situated inside the loop formed by the fixing belt 38. As the pressure pad 60 receives pressure from the pressure roller 30, the stay 61C1 supports the pressure pad 60 to prevent bending of the pressure pad 60 and produce a predetermined nip length in the sheet conveyance direction DP throughout the entire width of the fixing belt 38 in the axial direction thereof parallel to a longitudinal direction of the pressure pad 60. The stay 61C1 is mounted on and secured to flanges 70 serving as a holder at both lateral ends of the stay 61C1 in a longitudinal direction thereof parallel to the axial direction of the fixing belt 38, respectively, thus being positioned inside the first comparative fixing device 12C1. A reflection plate 40C1 interposed between the halogen heater 50 and the stay 61C1 reflects heat or light radiated from the halogen heater 50 to the reflection plate 40C1 toward the fixing belt 38, preventing the stay 61C1 from being heated by the halogen heater 50 with radiant heat or light and thereby reducing waste of energy. Alternatively, instead of the reflection plate 40C1, an opposed face of the stay 61C1 disposed opposite the halogen heater 50 may be treated with insulation or mirror finishing to reflect heat or light radiated from the halogen heater 50 to the stay 61C1 toward the fixing belt 38.

The pressure roller 30 is constructed of the cored bar 30*a*, the elastic layer 30*b*, and the release layer 30*c*. The elastic layer 30*b* coats the cored bar 30*a*. The release layer 30*c* coats the elastic layer 30*b* and is made of PFA, PTFE, or the like. As a driving force generated by a driver (e.g., a motor) situated inside the image forming apparatus 1 depicted in FIG. 1 is transmitted to the pressure roller 30 through a gear train, the pressure roller 30 rotates in the rotation direction D30. A spring or the like presses the pressure roller 30 against the pressure pad 60 via the fixing belt 38. As the spring presses and deforms the elastic layer 30*b* of the pressure roller 30, the pressure roller 30 produces the fixing nip SN having a predetermined length in the sheet conveyance direction DP. As illustrated in FIG. 3, the pressure roller 30 is a solid roller. Alternatively, the pressure roller 30 may be a hollow roller. In this case, a heater such as a halogen heater may be disposed inside the hollow roller. The elastic layer 30*b* may be made of solid rubber. Alternatively, if no heater is situated inside the pressure roller 30, the elastic layer 30*b* may be made of sponge rubber. The sponge rubber is more preferable than the solid rubber because the sponge rubber has an increased insulation that draws less heat from the fixing belt 38.

The driver (e.g., the motor) disposed inside the image forming apparatus 1 depicted in FIG. 1 drives and rotates the pressure roller 30. As the driver drives and rotates the pressure roller 30, a driving force of the driver is transmitted from the pressure roller 30 to the fixing belt 38 at the fixing nip SN, thus rotating the fixing belt 38 in accordance with rotation of the pressure roller 30 by friction between the pressure roller 30 and the fixing belt 38. The flange 70 is inserted into each lateral end of the fixing belt 38 in the axial direction thereof. Thus, the flange 70 rotatably supports the fixing belt 38 while guiding the fixing belt 38.

With the construction described above, the first comparative fixing device 12C1 attaining quick warm-up is manufactured at reduced costs.

However, the halogen heater 50 is substantially surrounded by the reflection plate 40C1 that may decrease a radiation amount of light that irradiates the fixing belt 38 and narrow an irradiation angle of light that irradiates the fixing belt 38, degrading heating efficiency in heating the fixing belt 38.

A description is provided of a construction of a second comparative fixing device 12C2.

Figure 4:
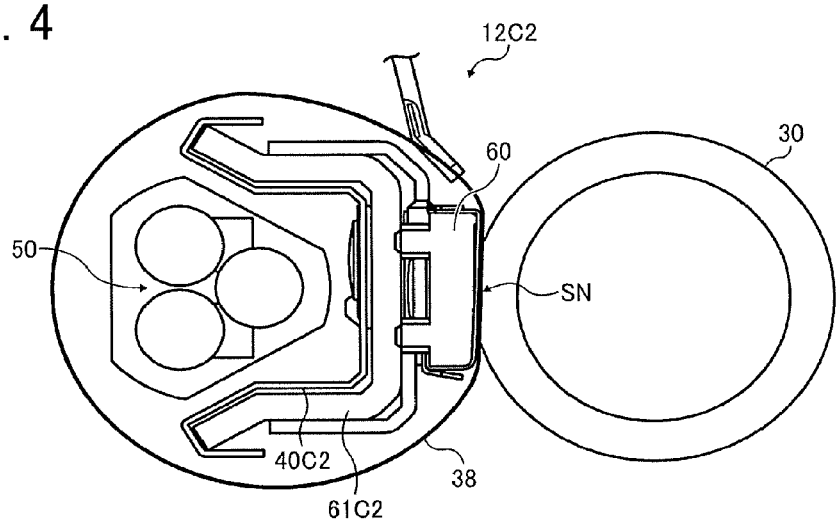
FIG. 4 is a schematic vertical cross-sectional view of a second comparative fixing device.

FIG. 4 is a schematic vertical cross-sectional view of the second comparative fixing device 12C2. The second comparative fixing device 12C2 includes three halogen heaters 50 serving as a heater or a heat source. As illustrated in FIG. 4, the three halogen heaters 50 are substantially surrounded by a stay 61C2 collectively. Hence, as the halogen heaters 50 are powered on, the three halogen heaters 50 may heat glass tubes thereof each other. Accordingly, the halogen heaters 50 may heat the fixing belt 38 with a degraded heating efficiency degraded by an amount of heat consumed to heat the glass tubes. Additionally, the three halogen heaters 50 are substantially surrounded by a reflection plate 40C2 that may decrease a radiation amount of light that irradiates the fixing belt 38 and narrow an irradiation angle of light that irradiates the fixing belt 38, degrading heating efficiency in heating the fixing belt 38.

A description is provided of a construction of a third comparative fixing device 12C3 and a fourth comparative fixing device 12C4.

Figure 5:
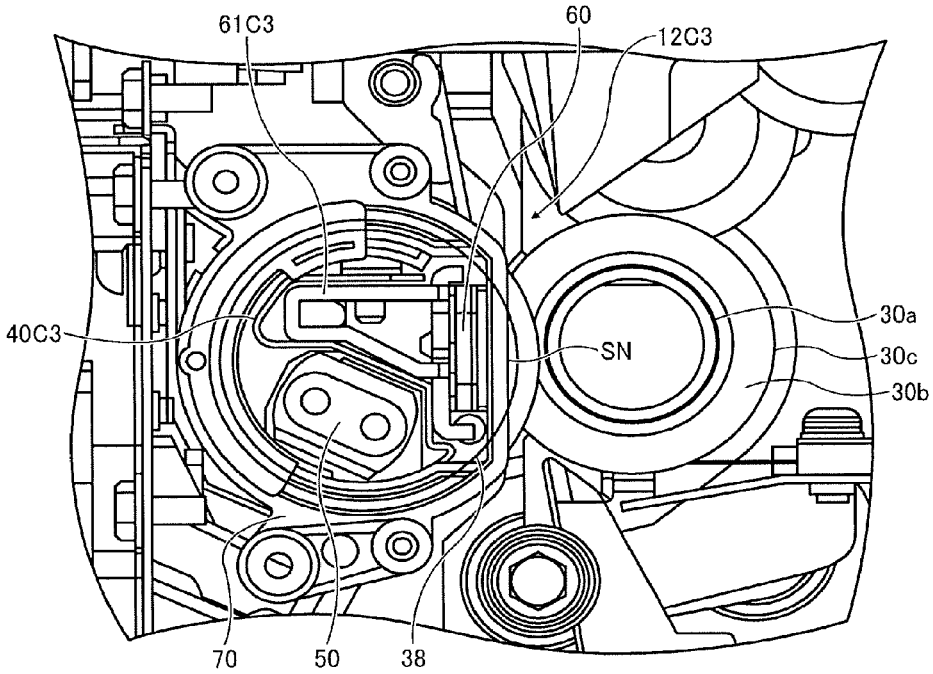
FIG. 5 is a schematic vertical cross-sectional view of a third comparative fixing device.
Figure 6:
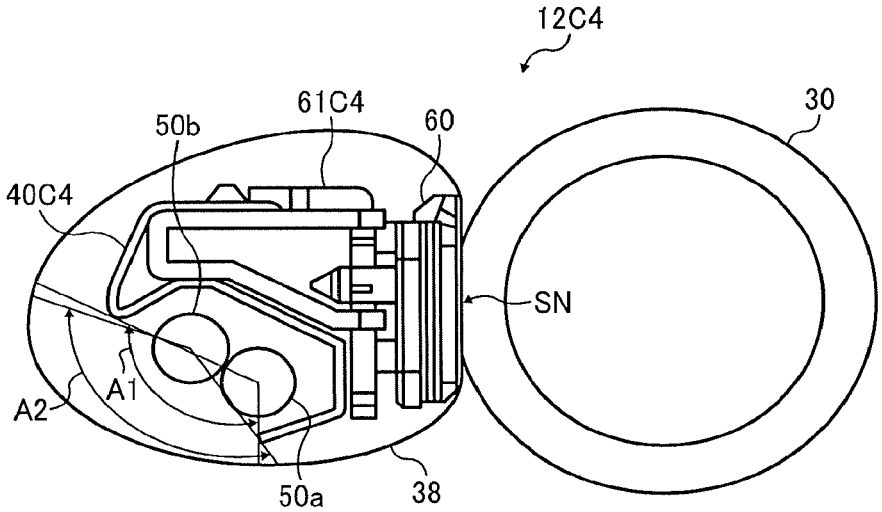
FIG. 6 is a schematic vertical cross-sectional view of a fourth comparative fixing device.

FIG. 5 is a schematic vertical cross-sectional view of the third comparative fixing device 12C3. The third comparative fixing device 12C3 includes two halogen heaters 50 serving as a heater or a heat source. FIG. 6 is a schematic vertical cross-sectional view of the fourth comparative fixing device 12C4. The fourth comparative fixing device 12C4 includes two halogen heaters 50*a* and 50*b* serving as a heater or a heat source. As illustrated in FIG. 5, the two halogen heaters 50 of the third comparative fixing device 12C3 are situated below a stay 61C3 collectively. Similarly, as illustrated in FIG. 6, the two halogen heaters 50*a* and 50*b* of the fourth comparative fixing device 12C4 are situated below a stay 61C4 collectively. Accordingly, as the halogen heaters 50 are powered on, the two halogen heaters 50 may heat glass tubes thereof each other. Similarly, as the halogen heaters 50*a* and 50*b* are powered on, the two halogen heaters 50*a* and 50*b* may heat glass tubes thereof each other. Consequently, the halogen heaters 50, 50*a*, and 50*b* may heat the fixing belt 38 with a degraded heating efficiency degraded by an amount of heat consumed to heat the glass tubes. Additionally, as illustrated in FIG. 6, the two halogen heaters 50*a* and 50*b* are substantially surrounded by a reflection plate 40C4 that may decrease a radiation amount of light that irradiates the fixing belt 38 and narrow irradiation angles A1 and A2 of light that irradiates the fixing belt 38, degrading heating efficiency in heating the fixing belt 38. A similar circumstance may occur with the two halogen heaters 50 of the third comparative fixing device 12C3 that are substantially surrounded by a reflection plate 40C3.

A description is provided of a construction of a fifth comparative fixing device 12C5.

Figure 7:
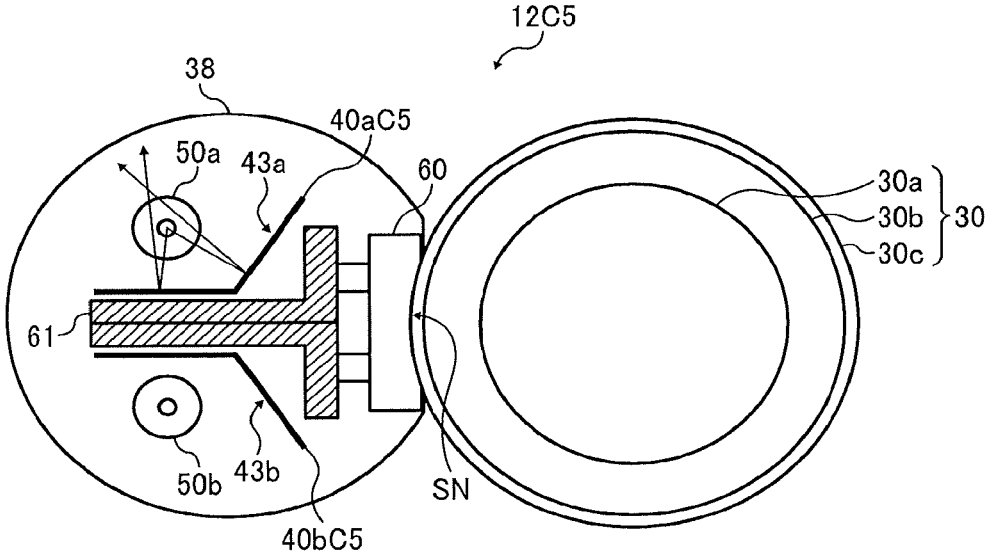
FIG. 7 is a schematic vertical cross-sectional view of a fifth comparative fixing device.

FIG. 7 is a schematic vertical cross-sectional view of the fifth comparative fixing device 12C5. The fifth comparative fixing device 12C5 includes two halogen heaters 50*a* and 50*b* serving as a heater or a heat source. As illustrated in FIG. 7, the two halogen heaters 50*a* and 50*b* of the fifth comparative fixing device 12C5 are disposed opposite each other via the stay 61 like the halogen heaters 50*a* and 50*b* depicted in FIG. 2. For example, the two halogen heaters 50*a* and 50*b* are aligned vertically in FIG. 7. Accordingly, as the halogen heaters 50*a* and 50*b* are powered on, the two halogen heaters 50*a* and 50*b* do not heat glass tubes thereof each other. Consequently, the halogen heaters 50*a* and 50*b* heat the fixing belt 38 with an improved heating efficiency enhanced by an amount of heat that may be consumed to heat the glass tubes. Since the halogen heater 50*a* is symmetric with the halogen heater 50*b* via the stay 61, light emitted from the halogen heaters 50*a* and 50*b* irradiates the fixing belt 38 with an identical incidence angle. As illustrated in FIG. 7, a part of light emitted by the halogen heater 50*a* may be reflected by a reflection plate 40*a*C5 and transmitted through the glass tube of the halogen heater 50*a*. Similarly, a part of light emitted by the halogen heater 50*b* may be reflected by a reflection plate 40*b*C5 and transmitted through the glass tube of the halogen heater 50*b*. Such light may heat the glass tube of the respective halogen heaters 50*a* and 50*b*. Thus, heat or light radiated from the halogen heaters 50*a* and 50*b* may be unnecessarily consumed to heat the glass tube of the respective halogen heaters 50*a* and 50*b* without being used to heat the fixing belt 38, degrading heating efficiency in heating the fixing belt 38.

A description is provided of a construction of a sixth comparative fixing device.

The sixth comparative fixing device includes a nip formation pad disposed inside a loop formed by a fixing belt to press against an abutment roller via the fixing belt to form a fixing nip between the fixing belt and the abutment roller. The nip formation pad includes a slide portion over which an inner circumferential surface of the fixing belt slides and a platy reinforcement projecting from the slide portion toward an interior of the loop formed by the fixing belt. The reinforcement is interposed between a plurality of heaters. A reflector is mounted on each side face of the reinforcement that is disposed opposite the heater. The reflector reflects radiant heat or light radiated from the heater toward the fixing belt. The reflector includes a projection (e.g., a gable) projecting toward the heater and having a summit disposed opposite the heater.

The radiant heat or light radiated from the heater irradiates a slope of the projection of the reflector. The slope of the projection reflects the radiant heat or light. An incidence angle of the radiant heat or light that irradiates the slope of the projection is not perpendicular to the slope of the projection. Accordingly, the reflector reflects the radiant heat or light in a reflection direction different from an incidence direction of the radiant heat or light. Consequently, the reflector prevents the reflected heat or light from being directed to and heating the heater, improving heating efficiency in heating the fixing belt.

The reflector is molded with the reinforcement of the nip formation pad pressing against the abutment roller via the fixing belt. The nip formation pad situated inside the loop formed by the fixing belt is secured to the sixth comparative fixing device at each lateral end of the sixth comparative fixing device in an axial direction of the fixing belt. Accordingly, the nip formation pad may be bent toward the interior of the loop formed by the fixing belt by pressure from the abutment roller. Consequently, the reflector molded with the reinforcement of the nip formation pad may be deformed in accordance with bending of the reinforcement. The summit of the projection (e.g., the gable) of the reflector may deviate from the heater in a direction in which the reinforcement projects from the slide portion. The deviated projection may fail to heat the fixing belt effectively.

The failure may also occur if the sixth comparative fixing device includes the heater disposed opposite one side face of the reinforcement, instead of the plurality of heaters disposed opposite both side faces of the reinforcement, respectively.

A detailed description is now given of the shape of the reflection plate 40*a* of the fixing device 12.

Figure 8:
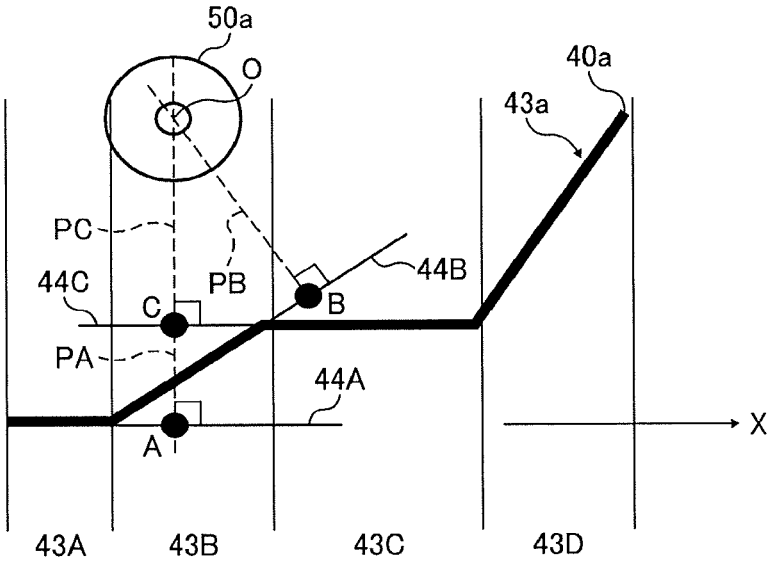
FIG. 8 is an enlarged view of an upper reflection plate incorporated in the fixing device depicted in FIG. 2.

FIG. 8 is an enlarged view of the upper reflection plate 40*a* of the fixing device 12 depicted in FIG. 2. As illustrated in FIG. 8, the reflection plate 40*a* includes a reflection face 43*a* including four reflection planes, that is, the reflection plane 43A, the reflection plane 43B, the reflection plane 43C, and a reflection plane 43D, which are disposed opposite the projection 61*d* of the stay 61. Hypothetical planes 44A, 44B, and 44C share identical hypothetical planes with the reflection planes 43A, 43B, and 43C, respectively. Perpendiculars PA, PB, and PC penetrating through an axis O of the halogen heater 50*a* intersect the hypothetical planes 44A, 44B, and 44C at intersections A, B, and C, respectively. The intersections A, B, and C are disposed outside the reflection planes 43A, 43B, and 43C, respectively. That is, the reflection planes 43A, 43B, and 43C are contoured and the halogen heater 50*a* is positioned with respect to the reflection plate 40*a* such that the intersections A, B, and C are not on the reflection planes 43A, 43B, and 43C, respectively.

For example, if the reflection plane 43B extends to the intersection B where the reflection plane 43B reflects light emitted from the halogen heater 50*a*, since the light irradiates the reflection plane 43B at a right incidence angle, the reflection plane 43B reflects and returns the light in a return direction that is identical to an incidence direction of the light. Accordingly, the light reflected by the reflection plane 43B returns to the halogen heater 50*a*, heating the halogen heater 50*a*. To address this circumstance, as illustrated in FIG. 8, the reflection plane 43B does not extend to the intersection B. That is, the intersection B is a hypothetical point. Accordingly, light emitted from the halogen heater 50*a* is reflected by the reflection plane 43C at an intersection thereon that is disposed opposite the halogen heater 50*a* via the intersection B and the perpendicular PB defined by the axis O of the halogen heater 50*a* and the intersection B. Since the light emitted from the halogen heater 50*a* irradiates the reflection plane 43C at an angle other than the right angle, the reflection plane 43C reflects the light emitted from the halogen heater 50*a* in a reflection direction that is different from an incidence direction of the light. Accordingly, the light reflected by the reflection plane 43C does not return to the halogen heater 50*a*.

The same is applicable to the intersections A and C. For example, if the reflection plane 43A extends to the intersection A where the reflection plane 43A reflects light emitted from the halogen heater 50*a* and if the reflection plane 43C extends to the intersection C where the reflection plane 43C reflects light emitted from the halogen heater 50*a*, the light irradiates the reflection planes 43A and 43C at a right incidence angle. Accordingly, the reflection planes 43A and 43C reflect the light in a reflection direction identical to an incidence direction of the light, thus returning the light to the halogen heater 50*a*. To address this circumstance, light emitted from the halogen heater 50*a* is reflected by the reflection plane 43B at an intersection thereon where the perpendiculars PA and PC defined by the axis O of the halogen heater 50*a* and the intersections A and C, respectively, intersect the reflection plane 43B. Since the light emitted from the halogen heater 50*a* irradiates the reflection plane 43B at an angle other than the right angle, the reflection plane 43B reflects the light emitted from the halogen heater 50*a* in a reflection direction that is different from an incidence direction of the light. Accordingly, the light reflected by the reflection plane 43B does not return to the halogen heater 50*a*.

Although the above describes the shape of the upper reflection plate 40*a* of the fixing device 12, since the lower reflection plate 40*b* includes a reflection face 43*b* depicted in FIG. 2 that has a shape equivalent to the shape of the reflection face 43*a* of the upper reflection plate 40*a*, the lower reflection plate 40*b* achieves advantages regarding reflection of light emitted from the halogen heater 50*b* that are similar to the advantages of the upper reflection plate 40*a* described above.

A description is provided of a configuration of a reflection plate 40*a*S as a variation of the reflection plate 40*a* depicted in FIG. 8.

Figure 9:
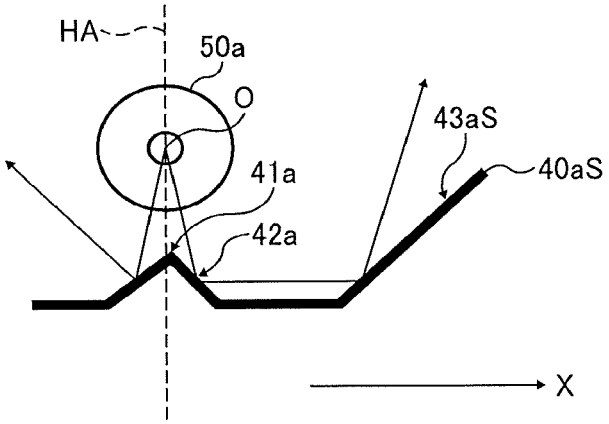
FIG. 9 is an enlarged view of a reflection plate as a variation of the reflection plate depicted in FIG. 8.

FIG. 9 is an enlarged view of the reflection plate 40*a*S. As illustrated in FIG. 9, the reflection plate 40*a*S includes a projection 42*a* (e.g., a gable) projecting toward the halogen heater 50*a* and having a summit 41*a* disposed opposite the halogen heater 50*a*. In order to prevent a reflection face 43*a*S of the reflection plate 40*a*S from directing light emitted from the halogen heater 50*a* back to the halogen heater 50*a*, the reflection face 43*a*S of the reflection plate 40*a*S mounts the projection 42*a*. The summit 41*a* of the projection 42*a* of the reflection plate 40*a*S and the axis O of the halogen heater 50*a* are aligned on a hypothetical alignment line HA to maximize heating efficiency in heating the fixing belt 38. However, if the reflection plate 40*a*S shifts from the halogen heater 50*a* and therefore the summit 41*a* of the projection 42*a* of the reflection plate 40*a*S deviates from the axis O of the halogen heater 50*a*, disadvantages may occur as below. A first disadvantage is that the projection 42*a* of the reflection plate 40*a*S may reflect and direct light emitted from the halogen heater 50*a* back to the halogen heater 50*a*, degrading heating efficiency in heating the fixing belt 38. A second disadvantage is that one of slopes of the projection 42*a* of the reflection plate 40*a*S may reflect light emitted from the halogen heater 50*a* but another one of the slopes of the projection 42*a* may not reflect light emitted from the halogen heater 50*a*, degrading heating efficiency in heating the fixing belt 38.

Figure 10:
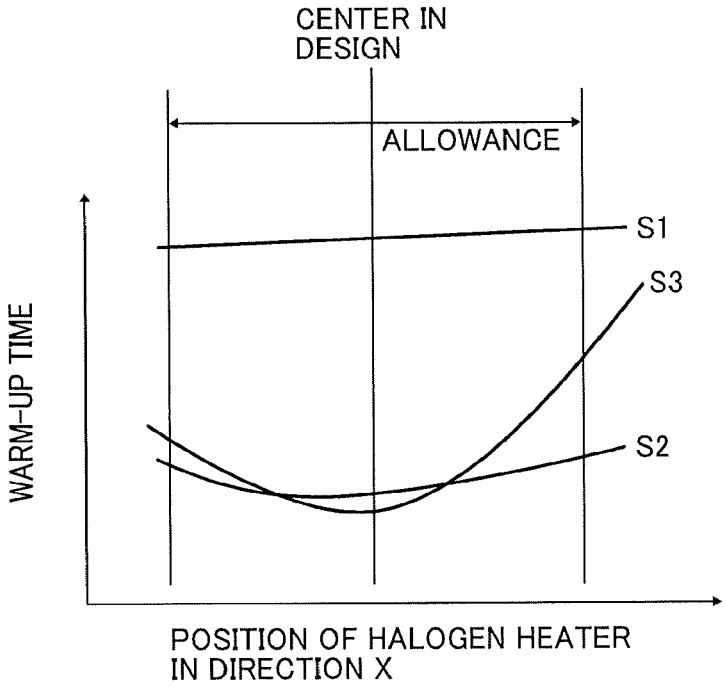
FIG. 10 is a graph illustrating a relation between a position of a halogen heater and a warm-up time to warm up a fixing belt incorporated in the fixing device depicted in FIG. 2 and the fifth comparative fixing device depicted in FIG. 7.

FIG. 10 is a graph illustrating a relation between a position of the halogen heater 50*a* in a direction X depicted in FIGS. 8 and 9 and a warm-up time to warm up the fixing belt 38. FIG. 10 illustrates a curve S1 representing the relation with the reflection plate 40*a*C5 depicted in FIG. 7, a curve S2 representing the relation with the reflection plate 40*a* depicted in FIG. 8, and a curve S3 representing the relation with the reflection plate 40*a*S depicted in FIG. 9. When the axis O of the halogen heater 50*a* deviates from the summit 41*a* of the projection 42*a* of the reflection plate 40*a*S rightward in FIG. 9, the reflection plate 40*a*S suffers from increase in multiple reflection, increasing the warm-up time substantially as illustrated by the curve S3 in FIG. 10. Conversely, with the reflection plate 40*a* depicted in FIG. 8, the warm-up time does not fluctuate and is constant regardless of the position of the halogen heater 50*a* in the direction X as illustrated by the curve S2 in FIG. 10.

As illustrated in FIG. 10, the curve S3 obtained with the reflection plate 40*a*S depicted in FIG. 9 achieves a shortened warm-up time at a certain position of the halogen heater 50*a* compared to the curve S2 obtained with the reflection plate 40*a* depicted in FIG. 8. However, in view of variation in parts and assembly, the reflection plate 40*a* depicted in FIG. 8 is advantageous over the reflection plate 40*a*S depicted in FIG. 9. Additionally, decreased variation in warm-up time and temperature increase of the fixing belt 38 facilitates design in temperature control. Accordingly, it is important that performance does not vary substantially depending on the position of the halogen heater 50*a* in the direction X. Consequently, the reflection plate 40*a* depicted in FIG. 8 is more desirable than the reflection plate 40*a*S depicted in FIG. 9.

With the fixing device 12 depicted in FIG. 2 that employs the reflection plates 40*a* and 40*b*, even if the reflection plates 40*a* and 40*b* shift slightly from the halogen heaters 50*a* and 50*b*, respectively, the reflection plates 40*a* and 40*b* do not direct light emitted from the halogen heaters 50*a* and 50*b* back to the halogen heaters 50*a* and 50*b*, improving heating efficiency in heating the fixing belt 38. Additionally, the reflection plates 40*a* and 40*b* contoured as illustrated in FIG. 2 enhance heating performance to heat the fixing belt 38 by improving robustness against a positional relation between the halogen heaters 50*a* and 50*b* and the reflection plates 40*a* and 40*b*.

If the reflection plate 40*a*S depicted in FIG. 9 is bent to produce the projection 42*a*, a surface of the reflection face 43*a*S may degrade, decreasing the reflectance of the reflection plate 40*a*S. For example, when the reflection plate 40*a*S is bent, an outer face of the projection 42*a* is stretched. Accordingly, the greater a bend angle at which the reflection plate 40*a*S is bent, the more the reflection plate 40*a*S suffers from fissure or crack. The reflection plate 40*a*S may be constructed of an aluminum base and a silver layer having an increased reflectance and coating the base by vapor deposition. However, a surface of the silver layer treated with vapor deposition may suffer from fissure or crack, decreasing the reflectance. Further, the reflection face 43*a*S is treated with mirror finishing to increase the reflectance. However, mirror finishing of the reflection face 43*a*S may suffer from degradation. Conversely, with the reflection plate 40*a* depicted in FIG. 8, the reflection plate 40*a* is bent to produce the four reflection planes 43A, 43B, 43C, and 43D in a bend amount smaller than a bend amount with which the reflection plate 40*a*S is bent to produce the projection 42*a*. Accordingly, the reflection plate 40*a* is immune from fissure or crack on a surface of the reflection face 43*a*, improving heating efficiency in heating the fixing belt 38.

The exemplary embodiments described above are one example and attain advantages below in a plurality of aspects A to D.

A description is provided of advantages of the fixing device 12 in an aspect A.

As illustrated in FIG. 2, a fixing device (e.g., the fixing device 12) includes a fixing rotator (e.g., the fixing belt 38), a pressure rotator or an abutment rotator (e.g., the pressure roller 30), a nip formation assembly (e.g., the nip formation assembly 62) including a nip formation pad (e.g., the pressure pad 60) and a reinforcement (e.g., the stay 61), a heater (e.g., the halogen heaters 50*a* and 50*b*), and a reflector (e.g., the reflection plates 40*a* and 40*b*). The fixing rotator is rotatable in a predetermined direction of rotation (e.g., the rotation direction D38). The pressure rotator contacts or presses against an outer circumferential surface of the fixing rotator in the pressurization direction DR. The nip formation assembly disposed inside the fixing rotator presses against the pressure rotator via the fixing rotator to form the fixing nip SN between the fixing rotator and the pressure rotator, through which a recording medium (e.g., a sheet P) bearing a toner image T is conveyed. The nip formation pad is disposed opposite the fixing nip SN. The reinforcement includes a projection (e.g., the projection 61*d*) projecting from the nip formation pad in the pressurization direction DR of the pressure rotator. For example, the projection projects from the nip formation pad toward an interior of the fixing rotator. The heater is disposed inside the fixing rotator and disposed opposite an opposed face (e.g., the opposed faces 61*a* and 61*b*) of the projection. The heater heats the fixing rotator with radiant heat or light. The reflector is disposed opposite the reinforcement. For example, the reflector is in contact with or in proximity to the reinforcement.

As illustrated in FIG. 8, the reflector includes a reflection face (e.g., the reflection face 43*a*) to reflect the radiant heat or light radiated from the heater to the fixing rotator. The reflection face includes a first parallel plane (e.g., the reflection plane 43A), a second parallel plane (e.g., the reflection plane 43C), and a third tilt plane (e.g., the reflection plane 43B) that are disposed opposite the projection of the reinforcement. The second parallel plane is parallel to the first parallel plane and stepped with respect to the first parallel plane. The third tilt plane bridges the first parallel plane and the second parallel plane. The first parallel plane is distanced from the nip formation pad and the heater farther than the second parallel plane is. In other words, the second parallel plane is disposed closer to the fixing nip SN and the heater than the first parallel plane is. The third tilt plane is disposed opposite the heater.

Accordingly, as described above, even if the reflector is shifted relative to the heater, the reflection face of the reflector does not direct the radiant heat or light radiated from the heater back to the heater, preventing the heat or light reflected by the reflector from heating the heater and therefore improving heating efficiency in heating the fixing rotator.

A description is provided of advantages of the fixing device 12 in an aspect B.

In the aspect A, the first parallel plane is leveled with a first hypothetical plane (e.g., the hypothetical plane 44A). The second parallel plane is leveled with a second hypothetical plane (e.g., the hypothetical plane 44C). The third tilt plane is leveled with a third hypothetical plane (e.g., the hypothetical plane 44B). A first perpendicular (e.g., the perpendicular PA) penetrating through the axis O of the heater intersects the first hypothetical plane at a first intersection (e.g., the intersection A). A second perpendicular (e.g., the perpendicular PC) penetrating through the axis O of the heater intersects the second hypothetical plane at a second intersection (e.g., the intersection C). A third perpendicular (e.g., the perpendicular PB) penetrating through the axis O of the heater intersects the third hypothetical plane at a third intersection (e.g., the intersection B). The heater is positioned with respect to the reflector such that the first intersection, the second intersection, and the third intersection are not on the first parallel plane, the second parallel plane, and the third tilt plane, respectively.

Accordingly, the first parallel plane, the second parallel plane, and the third tilt plane reflect the radiant heat or light in a reflection direction different from an incidence direction, preventing the reflected heat or light from returning to the heater.

A description is provided of advantages of the fixing device 12 in an aspect C.

In the aspect A or B, the projection projects in a projecting direction, that is, in the pressurization direction DR of the pressure rotator, that is perpendicular to a recording medium conveyance direction (e.g., the sheet conveyance direction DP) in which the recording medium is conveyed through the fixing nip SN and the projection is not directed to the nip formation pad. The first parallel plane and the second parallel plane are parallel to the projecting direction of the projection. Accordingly, the reinforcement and the reflector occupy a decreased space, downsizing the fixing device.

A description is provided of advantages of the fixing device 12 in an aspect D.

As illustrated in FIG. 1, an image forming apparatus (e.g., the image forming apparatus 1) includes an image forming device (e.g., the image forming device 2) to form a toner image T on a recording medium (e.g., a sheet P) with toner and a fixing device (e.g., the fixing device 12) disposed downstream from the image forming device in the recording medium conveyance direction to fix the toner image T on the recording medium at least under heat. The fixing device attains any one of the aspects A to C. Accordingly, the fixing device retains heating efficiency in heating the fixing rotator and therefore allows the entire image forming apparatus to save energy.

According to the exemplary embodiments described above, the fixing belt 38 serves as a fixing rotator. Alternatively, a fixing roller, a fixing film, a fixing sleeve, or the like may be used as a fixing rotator. Further, the pressure roller 30 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a pressure rotator to press against the fixing rotator in a pressurization direction to form a fixing nip between the fixing rotator and the pressure rotator, the fixing nip through which a recording medium bearing a toner image is conveyed;

a heater, disposed inside the fixing rotator, to heat the fixing rotator with radiant heat; and a reflector, disposed opposite the heater, to reflect the radiant heat radiated from the heater to the fixing rotator, the reflector including:

a first parallel plane;

a second parallel plane being parallel to the first parallel plane and stepped with respect to the first parallel plane, the second parallel plane being disposed closer to the fixing nip and the heater than the first parallel plane; and a third tilt plane bridging the first parallel plane and the second parallel plane and being disposed opposite the heater.

2. The fixing device according to claim 1, wherein the first parallel plane is leveled with a first hypothetical plane, the second parallel plane is leveled with a second hypothetical plane, and the third tilt plane is leveled with a third hypothetical plane, wherein a first perpendicular penetrating through an axis of the heater intersects the first hypothetical plane at a first intersection, a second perpendicular penetrating through the axis of the heater intersects the second hypothetical plane at a second intersection, and a third perpendicular penetrating through the axis of the heater intersects the third hypothetical plane at a third intersection, and wherein the heater is positioned with respect to the reflector such that the first intersection, the second intersection, and the third intersection are not on the first parallel plane, the second parallel plane, and the third tilt plane, respectively.

3. The fixing device according to claim 1, further comprising a nip formation assembly disposed inside the fixing rotator to press against the pressure rotator via the fixing rotator to form the fixing nip.

4. The fixing device according to claim 3, wherein the nip formation assembly includes:

a nip formation pad disposed opposite the fixing nip; and a reinforcement supporting the nip formation pad and including a projection projecting from the nip formation pad in the pressurization direction of the pressure rotator.

5. The fixing device according to claim 4, wherein the heater and the reflector are disposed opposite the projection of the nip formation assembly.

6. The fixing device according to claim 4, wherein the reflector contacts the reinforcement.

7. The fixing device according to claim 4, wherein the reflector is in proximity to the reinforcement.

8. The fixing device according to claim 4, wherein the pressurization direction of the pressure rotator in which the projection projects is perpendicular to a recording medium conveyance direction in which the recording medium is conveyed through the fixing nip, and wherein the first parallel plane and the second parallel plane are parallel to the projection projecting in the pressurization direction.

9. The fixing device according to claim 4, wherein the reflector covers the projection of the nip formation assembly.

10. The fixing device according to claim 3, wherein the reflector includes a polygonal plate in cross-section to shield the nip formation assembly from the heater.

11. The fixing device according to claim 1, wherein the fixing rotator includes an endless belt.

12. The fixing device according to claim 1, wherein the pressure rotator includes a pressure roller.

13. An image forming apparatus comprising:

an image forming device to form a toner image on a recording medium; and a fixing device disposed downstream from the image forming device in a recording medium conveyance direction to fix the toner image on the recording medium, the fixing device including:

a fixing rotator rotatable in a predetermined direction of rotation;

a pressure rotator to press against the fixing rotator in a pressurization direction to form a fixing nip between the fixing rotator and the pressure rotator, the fixing nip through which the recording medium bearing the toner image is conveyed;

a heater, disposed inside the fixing rotator, to heat the fixing rotator with radiant heat; and a reflector, disposed opposite the heater, to reflect the radiant heat radiated from the heater to the fixing rotator, the reflector including:

a first parallel plane;

a second parallel plane being parallel to the first parallel plane and stepped with respect to the first parallel plane, the second parallel plane being disposed closer to the fixing nip and the heater than the first parallel plane; and a third tilt plane bridging the first parallel plane and the second parallel plane and being disposed opposite the heater.

* * * * *